US005868396A

United States Patent [19]

Theissen

[11] Patent Number: 5,868,396

[45] Date of Patent: Feb. 9, 1999

[54] MOVABLE TARGET FOR SHOOTING PRACTICE

[75] Inventor: Peter-Paul Theissen, Haan, Germany

[73] Assignee: TTS Theissen Training Systems GmbH, Germany

[21] Appl. No.: 610,142

[22] Filed: Feb. 29, 1996

[30] Foreign Application Priority Data

Jan. 16, 1996 [DE] Germany ..... 196 01 384.4

[51] Int. Cl.[6] ..... F41J 9/00

[52] U.S. Cl. ..... 273/406; 273/366; 238/10 R

[58] Field of Search ..... 238/10 R; 104/126; 273/407, 406, 359, 366–370, 386

[56] References Cited

U.S. PATENT DOCUMENTS

| | | | |
|---|---|---|---|
| Re. 30,013 | 5/1979 | Knight | 273/369 |
| 1,800,236 | 4/1931 | Wasson . | |
| 3,324,832 | 6/1967 | McCain | 273/369 |
| 3,884,491 | 5/1975 | Hughart . | |
| 5,228,706 | 7/1993 | Boville . | |
| 5,568,927 | 10/1996 | Badorrek | 273/366 |

FOREIGN PATENT DOCUMENTS

| | | | |
|---|---|---|---|
| 327522 | 12/1902 | France . | |
| 330884 | 8/1903 | France | 273/366 |
| PA465628128 | 8/1967 | Germany . | |
| 1 534 123 | 7/1969 | Germany . | |
| G8432990.4 | 2/1985 | Germany . | |
| 4402891A1 | 8/1995 | Germany . | |
| 28908 | 12/1910 | United Kingdom | 273/406 |
| GB2155978 | 10/1985 | United Kingdom . | |

OTHER PUBLICATIONS

Eine Eisenbahn, die keiner kennt, Schmalspurbahn im Kugelhagel von Nato–Panzern, enbahn magazin Feb. 1978, p. 33.

Zieldarstellungen fur das GefechtsschieBen auf Truppenubungsplatzen des Heeres, Bestandsaufnahme, Militarische Forderungen, Neue Entwicklungen, wt May 1988, pp. 93–98.

Dart Target Systems, A Total Concept for Weapon Training Product Information, 1979.

Trolley Target System BT37S, Datasaab, Sweden.

*Primary Examiner*—Mark S. Graham

*Attorney, Agent, or Firm*—Steven F. Caserza; Flehr Hohbach Test Albritton & Herbert LLP

[57] ABSTRACT

A movable target for shooting practice, comprising a multiplicity of railtrack sections, which can be joined together, and a carriage which can be displaced along the assembled rail-track sections by means of a carriage drive and receives a target arrangement, whose target-retaining means, which receives at least one target such that it can be exchanged, can be moved between a neutral position and a target position by means of a target drive. The rail-track sections exhibit feet, which can be stacked one inside the other, and complementary connecting parts at the ends, and provision is made for end-side buffer stops with corresponding connecting parts, the carriage exhibiting, at one end, transporting wheels which are connected releasably to said carriage and of which the diameter is greater than that of the carriage wheels, and, at the opposite end, a handle.

16 Claims, 4 Drawing Sheets

MOVABLE TARGET FOR SHOOTING PRACTICE

RELATED APPLICATIONS

This application is related to copending U.S. patent application Ser. No. 08/610,144 (attorney docket number A63037) entitled "TARGET ARRANGEMENT", and Ser. No. 08/610,143 (attorney docket number A63038) entitled "TARGET ARRANGEMENT".

BACKGROUND OF THE INVENTION

The invention relates to a movable target for shooting practice.

Movable targets for shooting practice, in the case of which provision is made for a multiplicity of rail-track sections, which can be joined together, and a carriage which can be displaced along the assembled railtrack sections by means of a carriage drive and receives a target arrangement, whose target-retainer, which receives a target such that it can be exchanged, can be moved between a neutral position and a target position by means of a target drive, are known. Movable targets of this type are heavy and thus result in corresponding problems, as regards transportation, assembly and dismantling, on outdoor terrain.

SUMMARY

The object of the invention is to provide a movable target which has a low weight and can be easily transported and assembled and dismantled in a simple and rapid manner on outdoor terrain. In accordance with the teachings of this invention, a movable target is taught having easy-to-handle, lightweight rail-track sections, including feet, which can be stacked one inside the other, and complementary plug-in connecting parts at the ends, and endside buffer stops with corresponding plug-in connecting parts. A carriage, which bears a target arrangement and is provided with a carriage drive includes at one end, an axle which is connected releasably to said carriage and has transporting wheels, of which the diameter is greater than that of the carriage wheels, and, at the opposite end, a handle which can expediently be pulled out. It is possible to transport the rail-track sections as a stack, to join them together in a simple manner and to attach the buffer stops easily, while it is just as easy for the latter to be pulled or pushed by one person, on outdoor terrain, using the carriage, bearing the target arrangement on separate, easily removable wheels. This thus provides simple transportation, even on outdoor terrain, with the space-saving arrangement of the individual components and simple, rapid assembly and dismantling.

BRIEF DESCRIPTION OF THE DRAWINGS

The invention is explained in more detail hereinbelow with reference to an exemplary embodiment represented in the accompanying drawings, in which.

DETAILED DESCRIPTION

Figure 1:
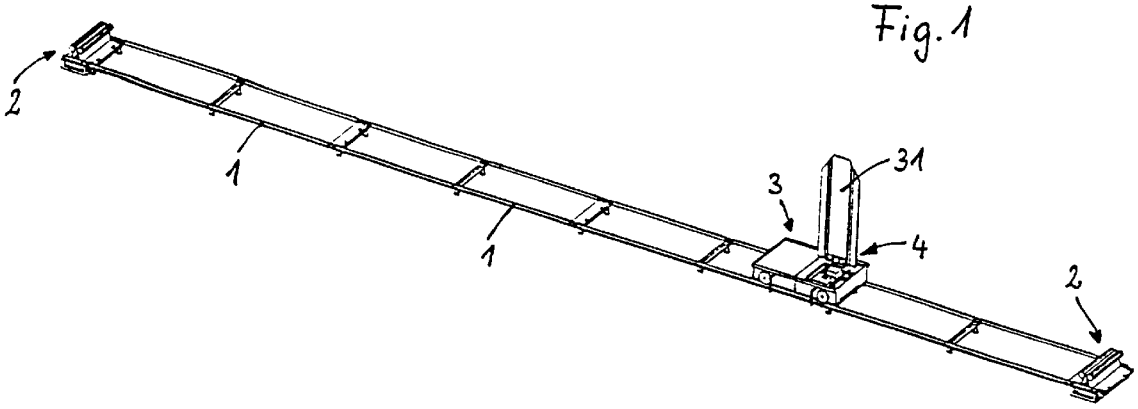
FIG. 1 shows, in perspective, one embodiment of a movable target constructed in accordance with this invention.

The embodiment of a movable target constructed according to the present invention shown in FIG. 1 comprises a rail track which is made of a plurality of rail-track sections 1 and end-side buffer stops 2 and along which a carriage 3 can be displaced, the latter bearing a target arrangement 4.

Figure 2:
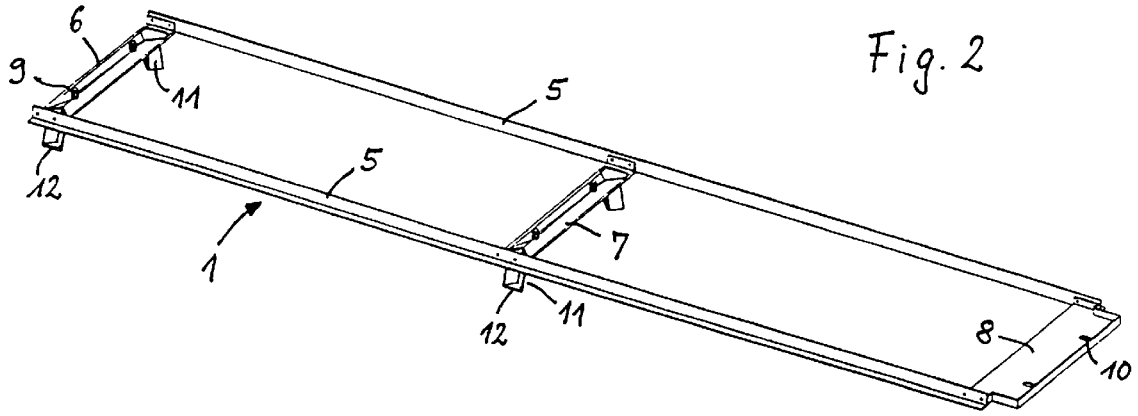
FIG. 2 shows, in perspective, an embodiment of a rail-track section suitable for use with the movable target of FIG. 1.

As can be seen from FIG. 2, in one embodiment each rail-track section 1 comprises two L-shaped rail sections 5 which are connected via three transverse webs 6, 7, 8, of which two are arranged at the ends and one is arranged approximately centrally between the two arranged at the ends. One end-side transverse web 6 is provided at the top with stubs 9, while the other end-side transverse web 8 includes openings 10 for the plug-in attachment of the stubs 9 of an end-side transverse web 6 of an adjacent rail-track section 1. In this manner, the rail-track sections 1 can be lined up one beside the other without difficulty in order to form a rail track.

Downwardly directed feet 11 are located at the ends of the transverse web 6, which includes the stubs 9, and of the central transverse web 7. The feet 11 are configured such that they can be stacked one inside the other, with the result that the rail-track sections 1 can be stacked one on top of the other to form a stack.

Figure 2A:
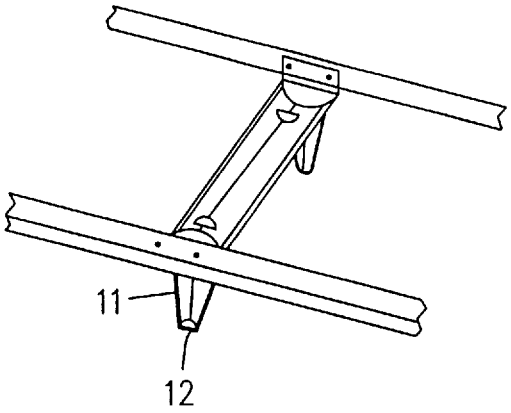
FIG. 2A shows an alternative embodiment for this invention, with conical feet.

For this purpose, the feet 11 are open towards the top and taper conically to a lower base plate 12. In one embodiment, in order to save weight, the feet 11 are, furthermore, L shaped in section with a triangular base plate 12 (FIG. 2), or are semicircular with a semicircular base plate 12 or the like (FIG. 2A), i.e. they are open to the side of the rail-track section 1.

The plate-like transverse web 8, which includes openings 10 and is provided with a reinforcement border, may, if desired, also be provided with feet 11.

In order that the stubs 9 are not a problem when the rail-track sections 1 are stacked together, the transverse webs 6 which include the stubs 9 are of a roof-shaped design, the stubs 9 being arranged on the ridge and the stubs 9 of a lower rail-track section 1 extending into the roof region of the transverse web 6 of the rail-track section 1 located above.

Figure 3:
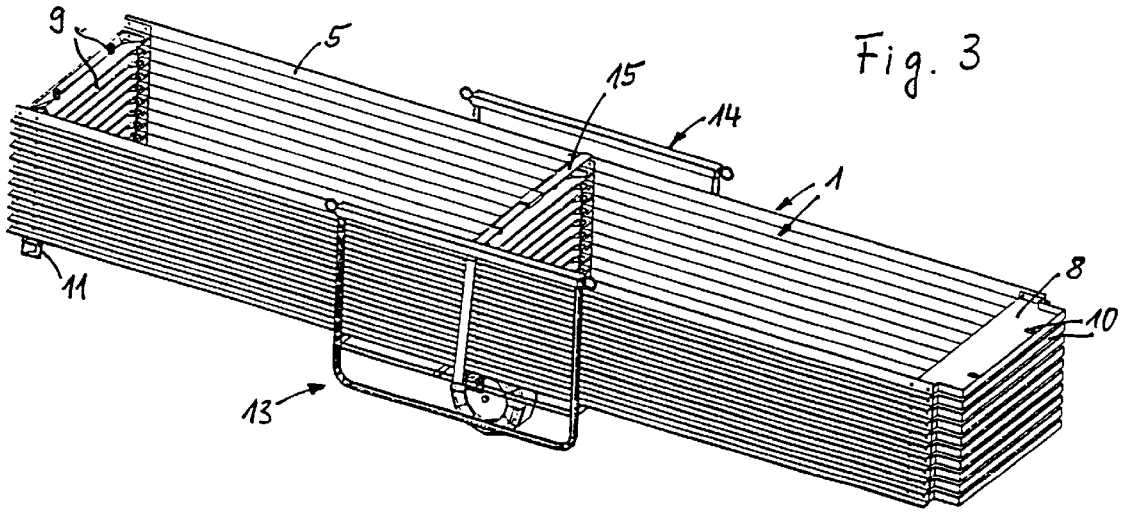
FIG. 3 shows in perspective, a stack of railtrack sections of FIG. 2.

The stack of rail-track sections 1 can be transported by means of a single-axle (or double-axle) railtrack transporting carriage 13, as shown in FIG. 3. The rail-track transporting carriage 13 has a receiving frame 14, which is open at both ends in the direction of travel and is intended for the stack, and a strap 15 for securing the stack. On account of the lightweight construction of the rail-track sections 1 using strutted L-profiles, the loaded railtrack transporting carriage 13 can be pulled or pushed by one or more individuals over the outdoor terrain up to the location where the movable target is to be erected.

Figure 4:
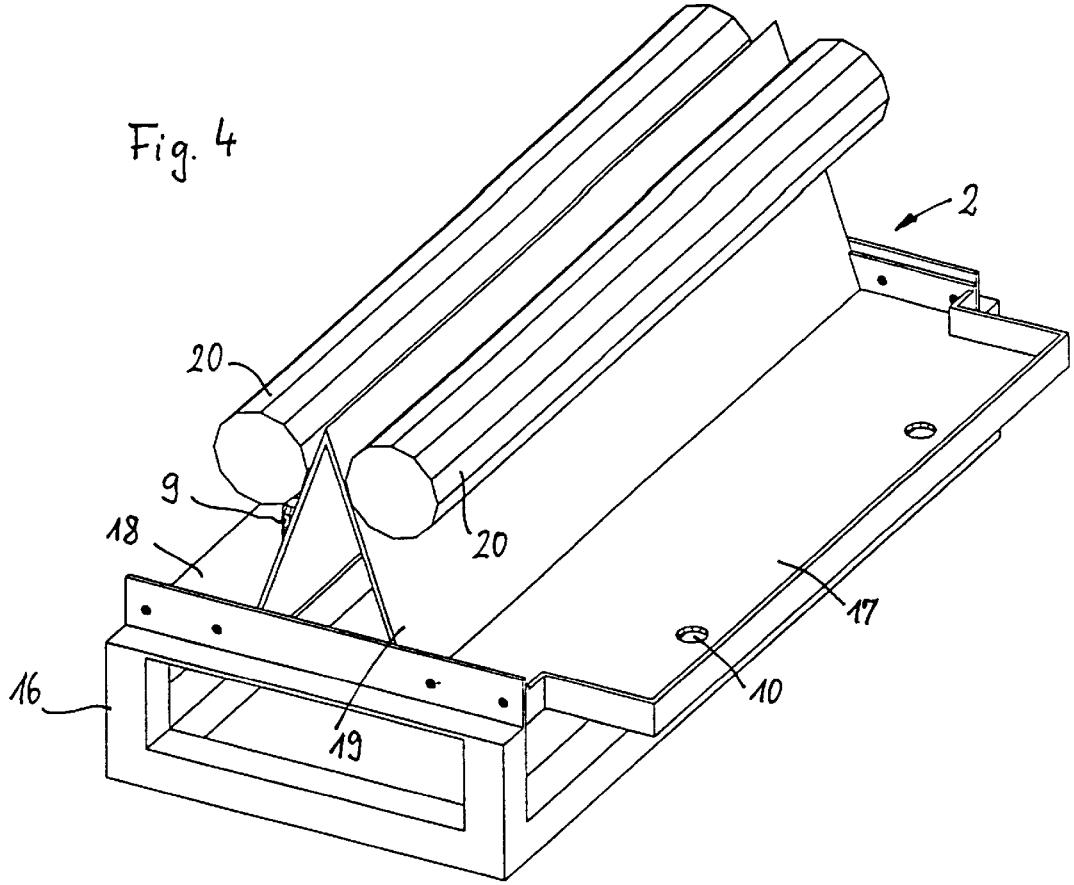
FIG. 4 shows, in perspective, an embodiment of a buffer stop for the target of FIG. 1.

As shown in FIG. 4, each buffer stop 2 comprises a frame 16 corresponding to the height of the feet 11 (FIG. 2), which frame expediently bears, on one side, a plate 17 with the openings 10 and, on the other side, a plate 18 with the stubs 9, with the result that each buffer stop 2 can be arranged at the right-hand end or at the left-hand end of the rail track.

Arranged between the two plates 17, 18 is a carrier 19 which is, here, in the shape of a roof and, on each side, bears a horizontal, cylindrical buffering element 20 as a stop for the carriage 3.

Figure 5:
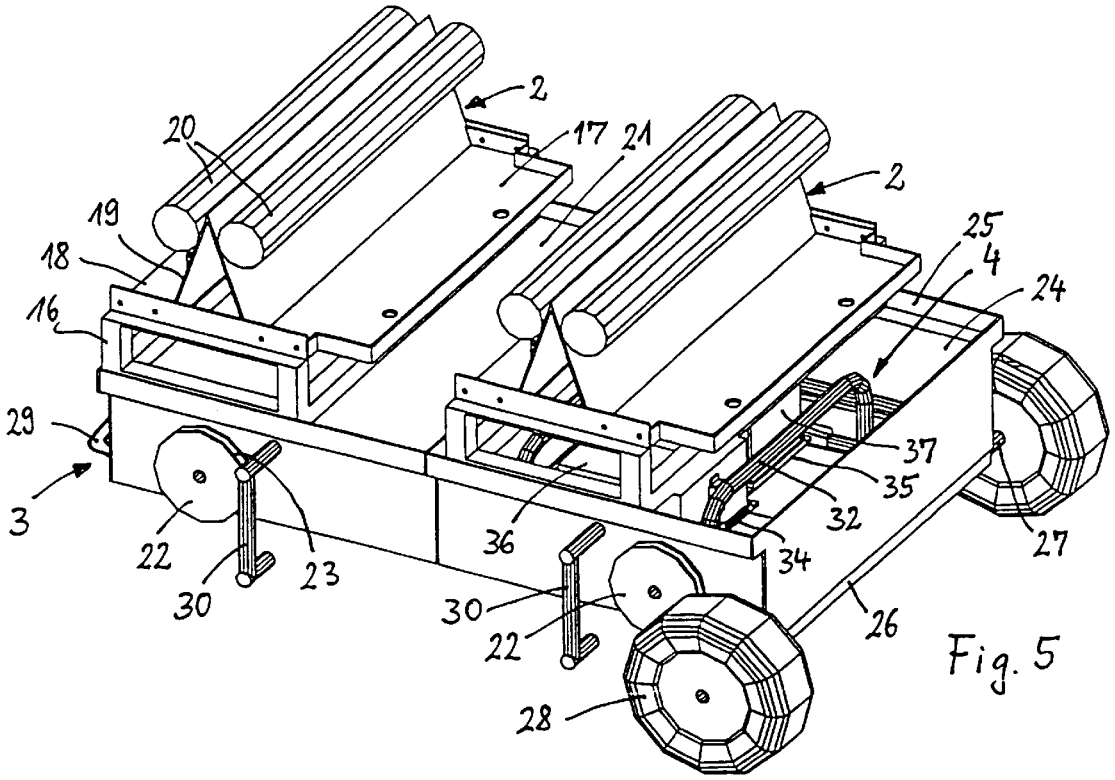
FIGS. 5 and 6 each show, in perspective, embodiments of a carriage for the movable target of FIG. 1 in the transporting state and with the target set up, respectively.

Referring to FIG. 5, the carriage 3 contains a battery-operated carriage drive (not shown) in a closed housing section 21, which drives one or both of the two pairs of carriage wheels 22 of the carriage 3. The carriage wheels 22 have a peripheral groove 23 for receiving the rail sections 5. The open housing section 24 of the carriage 3 receives the target arrangement 4.

The carriage 3 is provided, on both sides, with a laterally extended upper border 25, with the result that the two buffer stops 2 can be received one behind the other, and held in place, by the same, for storage and transportation.

At one end, the carriage 3 has a C-profile 26 on the underside as a receiver, which profile receives an axle 27 with transporting wheels 28, which preferably have tires, such that said axle can be released in a simple manner. The carriage 3 can easily be positioned, by means of its C-profile 26, on the axle 17 and, if desired, securing pins may also be fitted. A handle 29 which can be pulled out is provided at that end of the carriage 3 which is located opposite the C-profile 26, in order to raise and lower transporting wheels 28. In terms of their diameter, the transporting wheels 28 are considerably larger than the carriage wheels 22, to be precise they are at least large enough for the C-profile 26 to be at a higher level than the height of a rail-track section 1. The distance between the transporting wheels 28 conveniently need not be much greater than the width of a rail-track section 1.

The carriage 3 can thus be raised up when the handle 29 has been pulled out, with the result that it then rests only on the transporting wheels 28 and can thus be pulled or pushed over the outdoor terrain to the rail track. At one end of the rail track, the carriage 3 is then moved into position over the rail track and lowered, with the result that the carriage wheels 22 at the handle end come into engagement with the corresponding rail-track section 1. Thereafter, the other end of the carriage 3 is raised up, with the result that the axle 27 with the transporting wheels 28 is released, whereupon the carriage 3 is also positioned on the railtrack section 1 by the other pair of carriage wheels 22.

Subsequently, a buffer stop 2 is removed from the carriage 3 and fitted at the end of the rail track. Thereafter, the carriage 3 is displaced, either manually or automatically in a sensor-controlled manner, to the other end of the rail track, where the second buffer stop 2 is removed and fitted at that end of the rail track.

The carriage 3 may, furthermore, be provided with lateral bars 30 adjacent to the respective carriage wheels 22, which bars are arranged such that they can be pulled outwards, for example counter to the force of a spring, in order that, once they are released, they move back into their initial position, in which case they then engage beneath the rail sections 5 from the outside, in order thus to secure the carriage 3 on the rail track.

Figure 6:
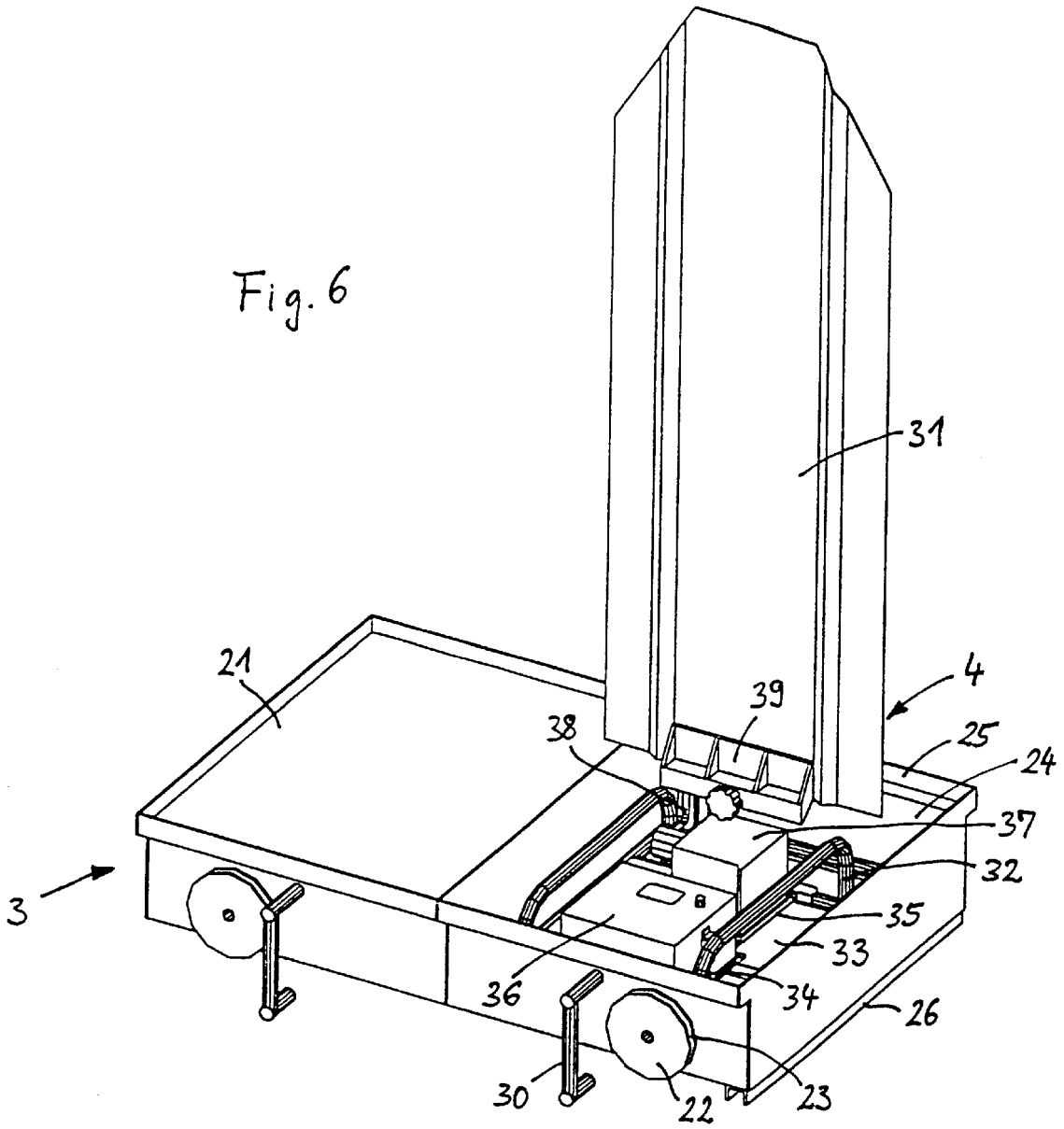

All that remains is to provide the target arrangement 4 with a target 31 (FIG. 6), and the movable target is then ready for use. The carriage drive comprises a corresponding control device via which the movement of the carriage 3 along the rail track is controlled.

Dismantling takes place in reverse order.

The battery-operated target arrangement 4 comprises a frame-like carrier 32 which is designed in an approximately rectangular manner, in the form of a tube structure and is provided with a base 33. Two receiving frames 34, 35 for a control unit, accommodated in a housing 36, and not more than two target drives, each arranged in a drive housing 37, are fastened on the base 33. The target drive has a shaft which projects laterally out of the drive housing 37 and on which there is seated, in the embodiment shown, an angled arm 38 which bears a target-retainer 39 for receiving a target 31 such that it can be exchanged.

The target drive, along with the arm 38 and the target-retainer 39, thus form a pivot device for the target 31, which device makes it possible for the target 31 to be pivoted between a horizontal position and a vertical position.

By virtue of corresponding rotation of the drive housing 37 such that the shaft projects upwards and by using a different connecting piece, instead of the arm 38, between the shaft and target-retainer 39, it is also possible for the target 31 to be rotated about a vertical axis between a neutral position and a target position.

If the target arrangement 4 receives two target drives, two targets 31, which may be actuated independently of one another, can be provided.

Instead of the stubs 9 and holes 10, use may also be made, on the rail sections 5, of quick-action clamping device fastened, for example, on the horizontal legs of said rail sections. The same applies for the buffer stops 2. Securing pins fastened on corresponding chains may be assigned to the stubs 9.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. A movable target for shooting practice, comprising:

a plurality of rail-track sections, each having first and second ends, each rail-track section comprising:

feet, which can be stacked one inside the other; and complementary connecting parts at each of said first and second ends, allowing a plurality of said rail-track sections to be joined together;

a carriage which can be displaced along a plurality of joined together rail-track sections, comprising:

carriage wheels for placement on said rail-track sections;

a carriage drive;

a target arrangement, having a target-retainer which receives at least one target such that it can be exchanged and moved between a neutral position and a target position, by means of a target drive;

transporting wheels connected releasably to said carriage near one end, and of which the diameter is greater than that of the carriage wheels; and a handle at an end of said carriage opposite said transporting wheels; and end-side buffer stops connectable to free ends of said plurality of joined rail-track sections.

2. A target according to claim 1, wherein said feet are open towards their top and taper conically to a base plate.

3. A target according to claim 1, wherein said feet are open to a side of the rail-track sections.

4. A target according to claims 1, 2, or 3, wherein said rail-track sections each comprise an end-side transverse web, which includes stubs, and an end-side transverse web which is provided with holes which correspond with the stubs.

5. A target according to claim 4, wherein said feet are arranged in the region of an endside and of a central transverse web of the rail-track sections.

6. A target according to claim 1 which further comprises an additional rail-track transporting carriage with a receiving frame for receiving a stack of a predetermined number of rail-track sections stacked one on top of the other.

7. A target according to claim 6, wherein said rail-track transporting carriage includes at least one fastening strap for the stack of rail-track sections.

8. A target according to claim 6, wherein said rail-track transporting carriage has a single axle.

9. A target according to claim 1, wherein said buffer stops can be used at said first and second ends and are provided with two complementary connecting parts.

10. A target according to claim 1, wherein said carriage can receive the buffer stops one beside the other.

11. A target according to claim 1, wherein said carriage comprises bars which can be pulled out laterally for engaging beneath rails of the rail-track sections.

12. A target according to claim 1, wherein said transporting wheels are arranged on an axle which can be connected releasably to the carriage.

13. A target according to claim 12, which further comprises a receiver for the axle of the transporting wheels arranged on the underside of the carriage.

14. A target according to claim 12, wherein said carriage comprises a C-profile which is open towards the bottom.

15. A target according to claim 1, which further comprises an axle, located beneath said carriage, for mounting said transporting wheels, the diameter of said transporting wheels being greater than the height of said rail-track sections, allowing said carriage to be moved over said rail-track sections.

16. A target according to claim 1, wherein said handle is arranged on the carriage such that it can be pulled out.

* * * * *